US008103038B2

(12) United States Patent
Akino et al.

(10) Patent No.: US 8,103,038 B2
(45) Date of Patent: Jan. 24, 2012

(54) BOUNDARY MICROPHONE

(75) Inventors: Hiroshi Akino, Machida (JP); Shioto Okita, Machida (JP); Satoshi Yoshino, Machida (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 1010 days.

(21) Appl. No.: 12/010,344

(22) Filed: Jan. 24, 2008

(65) Prior Publication Data

US 2008/0232629 A1 Sep. 25, 2008

(30) Foreign Application Priority Data

Jan. 31, 2007 (JP) ..... 2007-020609

(51) Int. Cl.
*H04R 9/08* (2006.01)
*H04R 9/06* (2006.01)

(52) U.S. Cl. ..... 381/355; 381/334; 381/356; 381/361; 381/369

(58) Field of Classification Search ..... 381/334, 381/355, 356, 361, 369
See application file for complete search history.

(56) References Cited

U.S. PATENT DOCUMENTS

2005/0163336 A1* 7/2005 Hiramoto et al. ..... 381/369
2006/0045302 A1* 3/2006 Akino et al. ..... 381/355

* cited by examiner

*Primary Examiner* — Long Tran
(74) *Attorney, Agent, or Firm* — Manabu Kanesaka

(57) ABSTRACT

In a boundary microphone, a high-frequency current caused by extraneous electromagnetic waves is prevented from flowing into a microphone case via a microphone cord that is drawn into the microphone case. A portion in which the microphone cord 31 consisting of a two-core shield covered wire is drawn into the microphone case 1 is made a shielding wire exposed part 310 formed by removing a skin 31*d*, and the shielding wire exposed part 310 is connected electrically to a base part 10 via an electrical connecting means 40 (preferably, a conductive cloth 41, and further preferably, the conductive cloth 41 that is formed into a washer shape having an insertion hole for the shielding wire exposed part 310 and is arranged so as to close a cord insertion hole 12), whereby the high-frequency current caused by extraneous electromagnetic waves is surely prevented from flowing into the microphone case 1.

4 Claims, 2 Drawing Sheets

BOUNDARY MICROPHONE

TECHNICAL FIELD

The present invention relates to a boundary microphone and, more particularly, to a technique for preventing the generation of noise caused by extraneous electromagnetic waves.

BACKGROUND ART

A boundary microphone (on-surface sound pickup microphone) is also called a surface mount microphone because it is used by being installed on a table or floor surface in a TV studio, a conference room, or the like. As described in Patent Document 1 (Japanese Utility Model Registration No. 2515812), the boundary microphone uses a flat microphone case.

One example thereof is explained by reference to FIG. 2. FIG. 2A is a sectional view in the lengthwise direction of a boundary microphone, and FIG. 2B is a sectional view in the width direction taken along the line II-II of FIG. 2A.

Referring to FIGS. 2A and 2B, a microphone case 1 used for a boundary microphone is basically made up of two elements: a flat metallic base part 10 the upper surface side of which is open, and a metallic microphone cover 20 having a large number of openings (sound wave introduction holes), which is attached to the base part 10 so as to cover the upper surface of the base part 10.

Usually, the base part 10 is formed by casting such as zinc die casting, and a rear wall part 11 thereof is formed with a cord insertion hole 12. Also, on the bottom surface of the base part 10, a cushioning rubber sheet 13 is provided along the bottom surface.

For the microphone cover 20, a punched plate (perforated plate) is used. In place of the punched plate, a wire net member is sometimes used. The microphone cover 20 is screwed to the base part 10 by using screws, not shown.

As the boundary microphone, a condenser microphone is usually used. The condenser microphone includes a microphone unit serving as a sound pickup section and an output module section (also referred to as a power module section) having a sound signal output circuit, a power supply circuit, an output connector, and the like.

In the case of a large-size boundary microphone, the microphone unit and the output module section are housed in the microphone case thereof. However, in a small-size boundary microphone, as shown in FIG. 2A, only the microphone unit 30 is housed in the microphone case 1, and the microphone unit 30 is connected to the output module section, not shown, which is provided outside the case, via a dedicated microphone cord 31.

In this case, in the microphone unit 30, a field effect transistor (FET) is incorporated as an impedance converter. As shown in FIG. 2B, the microphone unit 30 is fixed to the base part 10 by a fixing band 15, and the unit case on the earth side and the base part 10 are connected electrically to each other.

The microphone cord 31 is inserted through the cord insertion hole 12 via a rubber-made cord bush 14, and a binding band 16 for preventing coming-off is attached to the inside of the cord bush 14 to ensure a predetermined draw-out strength.

The microphone cord 31 includes a power wire 31*a* for supplying power from the output module section to the microphone unit 30, a signal wire 31*b* for giving sound signals, which are generated from the FET, to the output module section, and a shielding wire 31*c* that electrostatically shields the power wire 31*a* and the signal wire 31*b* and connects them to the ground. As the microphone cord 31, a two-core shield covered wire in which the outer periphery of the shielding wire 31*c* is covered with an electrical insulating outer skin 31*d* is used.

This microphone cord 31 is vulnerable to noise (electromagnetic waves etc.) coming from the outside because the sound signals are transmitted unbalancedly, which poses a problem of generation of noise caused by strong electromagnetic waves emitted from a cellular phone that has come into wide use rapidly in recent years.

When a cellular phone is used, considerably strong electromagnetic waves (for example, within the range of about several centimeters to several tens centimeters, a field intensity reaching tens of thousands times of field intensity produced in the city by commercial electric waves) are generated. If a high-frequency current caused by the electromagnetic waves intrudes into the microphone case 1, the current is detected by the FET incorporated in the microphone unit 30, and therefore noise is generated.

If the electrical connection between the base part 10 and the microphone cover 20 is stable in terms of high frequency, a big problem does not occur even if the microphone is subjected to strong electromagnetic waves. Thereupon, the applicant of the present invention has proposed, as Patent Document 2 (Japanese Patent Laid-Open No. 2005-333180), a technique in which a conductive cloth (conductive fabric) is held between the base part 10 and the microphone cover 20.

According to the invention described in Patent Document 2, an expected effect can be achieved for a shield of the circumference part of the microphone case.

However, in the case where the microphone cord 31 with some degree of length is laid in the microphone case 1 as shown in FIG. 2A, if a cellular phone is used in the vicinity of the microphone case 1, the high-frequency current cause by strong electromagnetic waves coming from the cellular phone flows into the shield of the microphone unit 30 via the shielding wire 31*c* of the microphone cord 31, and this current is detected by the FET, and therefore noise is sometimes generated.

Accordingly, an object of the present invention is to provide a boundary microphone in which a high-frequency current caused by extraneous electromagnetic waves is prevented from flowing into a microphone case via a microphone cord that is drawn into the microphone case.

SUMMARY OF THE INVENTION

To achieve the above object, the present invention provides a boundary microphone including a flat microphone case made up of a metallic base part the upper surface side of which is open and a metallic microphone cover having a large number of openings (sound wave introduction holes), which is attached to the base part so as to cover the upper surface of the base part, in which a condenser microphone unit including a field effect transistor (FET) serving as an impedance converter is housed in the microphone case, and a microphone cord consisting of a two-core shield covered wire having a skin is drawn in via a cord insertion hole formed in the base part and is connected electrically to the condenser microphone unit, wherein a portion in which the microphone cord is drawn into the microphone case is made a shielding wire exposed part formed by removing the skin, and the shielding wire exposed part is connected electrically to the base part via a predetermined electrical connecting means.

As the electrical connecting means, a conductive cloth (conductive fabric) is preferably used.

Also, the conductive cloth is preferably formed into a washer shape having an insertion hole for the shielding wire exposed part.

Further preferably, the conductive cloth formed into a washer shape is arranged so as to close the cord insertion hole in the microphone case.

According to the present invention, the portion in which the microphone cord is drawn into the microphone case is made the shielding wire exposed part formed by removing the skin, and the shielding wire exposed part is connected electrically to the base part via the predetermined electrical connecting means (preferably, the conductive cloth, and further preferably, the conductive cloth that is formed into a washer shape having an insertion hole for the shielding wire exposed part and is arranged so as to close a cord insertion hole), whereby a high-frequency current caused by extraneous electromagnetic waves is surely prevented from flowing into the microphone case.

DETAILED DESCRIPTION

Figure 1A:
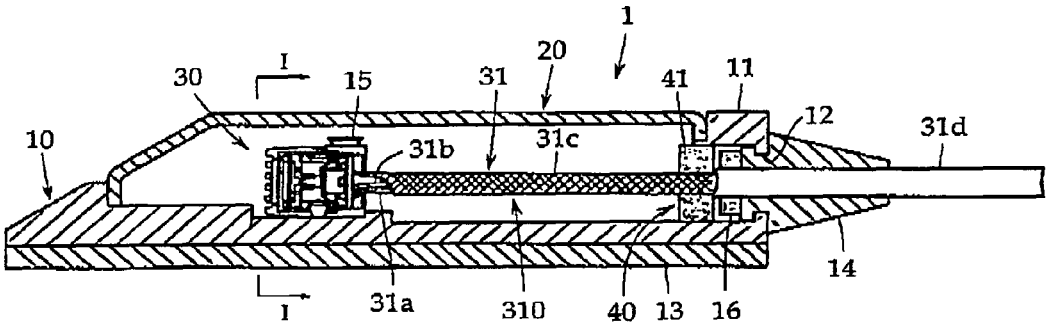
FIG. 1A is a sectional view showing an embodiment of a boundary microphone in accordance with the present invention.
Figure 1B:
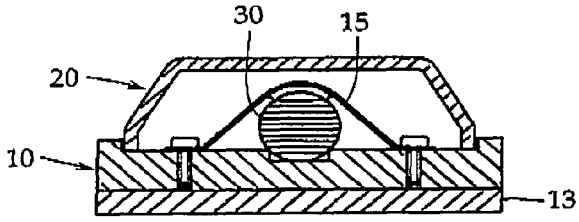
FIG. 1B is a sectional view taken along the line I-I of FIG. 1A.
Figure 2A:
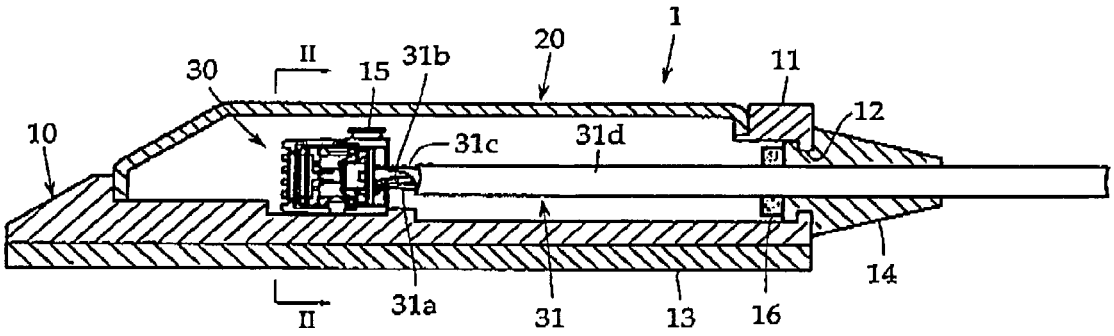
FIG. 2A PRIOR ART
FIG. 2A is a sectional view taken along the lengthwise direction of a conventional general boundary microphone.
Figure 2B:
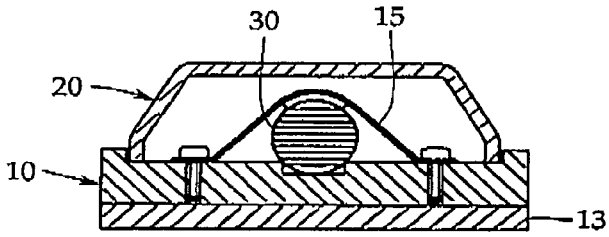
FIG. 2B PRIOR ART
FIG. 2B is a sectional view taken along the line II-II of FIG. 2A.

An embodiment of the present invention will now be described by reference to FIG. 1. FIG. 1A is a sectional view showing an embodiment of a boundary microphone in accordance with the present invention, being similar to FIG. 2A, and FIG. 1B is a sectional view taken along the line I-I of FIG. 1A. In these description of the embodiment, the same reference numerals are applied to elements that are the same as those of the conventional example shown in FIG. 2.

As shown in FIG. 1, the microphone case 1 of the boundary microphone in accordance with the present invention may, like the conventional example, be made up of two elements: a flat metallic base part 10 the upper surface side of which is open, and a metallic microphone cover 20 having a large number of openings (sound wave introduction holes), which is attached to the base part 10 so as to cover the upper surface of the base part 10.

The base part 10 is formed by casting such as zinc die casting, and a rear wall part 11 thereof is formed with a cord insertion hole 12. Also, on the bottom surface of the base part 10, a cushioning rubber sheet 13 is provided along the bottom surface. The base part 10 may be formed by a press-molded product of a metal.

For the microphone cover 20, a punched plate (perforated plate) is used. In place of the punched plate, a wire net member is sometimes used. The microphone cover 20 is screwed to the base part 10 by using screws, not shown.

As the boundary microphone, a condenser microphone is used. In this embodiment, the condenser microphone includes only a microphone unit 30 serving as a sound pickup section in the microphone case 1. An output module section not shown (also referred to as a power module section) having a sound signal output circuit, a power supply circuit, an output connector, and the like is placed outside the case, and the microphone unit 30 and the output module section are connected to each other via a dedicated microphone cord 31.

In this case as well, the microphone unit 30 incorporates a field effect transistor (FET) as an impedance converter. As shown in FIG. 1B, the microphone unit 30 is fixed to the base part 10 by a fixing band 15, and the unit case on the earth side and the base part 10 are connected electrically to each other.

The microphone cord 31 is inserted through the cord insertion hole 12 via a rubber-made cord bush 14, and a binding band 16 for preventing coming-off is attached to the inside of the cord bush 14 to ensure a predetermined draw-out strength.

As the microphone cord 31, a two-core shield covered wire is used which includes a power wire 31*a* for supplying power from the power module section to the microphone unit 30, a signal wire 31*b* for giving sound signals, which are generated from the FET, to the power module section, and a shielding wire 31*c* that electrostatically shields the power wire 31*a* and the signal wire 31*b* and connects them to the ground, the outer periphery of the shielding wire 31*c* being covered with an electrical insulating skin 31*d*. However, the microphone cord 31 differs from that in the conventional example explained by reference to FIG. 2 in the point described below.

In this embodiment, a portion of the microphone cord 31, which is drawn into the microphone case 1, that is, a portion ranging from the binding band 16 to the microphone unit 30 is made a shielding wire exposed part (a state in which the shield winding is exposed) 310 which the skin 31*d* is removed, and the shielding wire exposed part 310 is connected electrically to the base part 10 via an electrical connecting means 40.

According to this configuration, even if a cellular phone is used in the vicinity of the microphone case 1, and a high-frequency current caused by strong electromagnetic waves flows in the shielding wire 31*c*, in the microphone case 1, the high-frequency current is released to the base part 10 side via an electrical connecting means 40, so that the current is not detected by the FET in the microphone unit 30, and therefore noise is scarcely generated.

As the electrical connecting means 40, a lead wire may be used. However, from the viewpoint of the assembling workability and the reliability of prevention of high-frequency current, as the electrical connecting means 40, a conductive cloth (conductive fabric) 41 is preferably used. As a commercially available conductive cloth, for example, Conductive Fabric Sui-80-7860N (product number) manufactured by Seiren Co., Ltd. is available.

When the conductive cloth 41 is used, it is preferable that as shown in FIG. 1A, the conductive cloth 41 be formed into a washer shape having an insertion hole for the shielding wire exposed part 310, and be arranged so as to close the cord insertion hole 12 formed in the base part 10 in the vicinity of the binding band 16.

In this case, the conductive cloth 41 formed into a washer shape may be positioned between the binding band 16 and the cord bush 14. As a modification that achieves the effect of the present invention, the shielding wire exposed part 310 in the microphone case 1 may be made only a portion to which the conductive cloth 41 is connected, and the skin 31*d* may be caused to remain in other portions.

The present application is based on, and claims priority from, Japanese Application Serial Number JP2007-020609, filed Jan. 31, 2007, the disclosure of which is hereby incorporated by reference herein in its entirety.

The invention claimed is:

1. A boundary microphone comprising:

a flat microphone case having a metallic base part in which an upper surface side is open, and a metallic microphone cover having a plurality of sound wave introduction holes and attached to the base part to cover the upper surface side of the base part;

a condenser microphone unit, including a field effect transistor serving as an impedance converter, disposed in the microphone case;

a microphone cord having a two-core shield covered wire, a shielding wire covering the two-core shield covered wire, and an electrical insulating cover covering said shielding wire, said microphone cord inserted through a cord insertion hole arranged in the base part and connected electrically to the condenser microphone unit;

a binding band fixed on the cord for securing the cord in the microphone case; and an electrical connecting device disposed adjacent the cord insertion hole in the microphone case;

wherein the microphone cord includes a shielding wire exposed part formed in the microphone case where the shielding wire substantially entirely covering the two-core shield in the case is directly exposed in the case; said shielding wire exposed part extends from the binding band to the condenser microphone unit; and the electrical connecting device electrically connects said shielding wire exposed part to the base part so that a high-frequency current caused by electromagnetic waves is not detected by the field effect transistor, which prevents the generation of noise.

2. The boundary microphone according to claim 1, wherein a conductive cloth is used as the electrical connecting device.

3. The boundary microphone according to claim 2, wherein the conductive cloth is a washer shape having an insertion hole for receiving the shielding wire exposed part.

4. The boundary microphone according to claim 3, wherein the conductive cloth is arranged to close the cord insertion hole in the microphone case.

* * * * *